US012768114B2

(12) United States Patent
Nelson

(10) Patent No.: US 12,768,114 B2
(45) Date of Patent: Oct. 20, 2026

(54) ELECTRIC PROPULSION SYSTEM FOR PAVER MACHINES

(71) Applicant: Caterpillar Paving Products Inc., Brooklyn Park, MN (US)

(72) Inventor: Ryan James Nelson, Maple Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 23 days.

(21) Appl. No.: 18/983,839

(22) Filed: Dec. 17, 2024

(65) Prior Publication Data

US 2026/0168180 A1 Jun. 18, 2026

(51) Int. Cl.
*E01C 19/00* (2006.01)

(52) U.S. Cl.
CPC ..... *E01C 19/004* (2013.01)

(58) Field of Classification Search
CPC ..... E01C 19/004
USPC ..... 701/50
See application file for complete search history.

(56) References Cited

U.S. PATENT DOCUMENTS 4,681,374 A * 7/1987 Nakamura ..... B60T 8/175 180/197
5,998,959 A * 12/1999 Eisenhardt ..... B60L 50/51 318/807
8,521,384 B2 * 8/2013 O'Connor ..... A01D 34/006 701/72
8,786,244 B2 * 7/2014 Jang ..... H02P 23/14 318/473
9,982,401 B2 5/2018 Voegele
2005/0126145 A1 * 6/2005 Hunt ..... B62D 11/003 56/11.9
2006/0132084 A1 * 6/2006 DeLange ..... H02P 21/34 318/802
2009/0112427 A1 * 4/2009 Heap ..... B60W 20/00 701/67
2012/0061169 A1 * 3/2012 Oblizajek ..... B62D 5/0472 180/446
2015/0224845 A1 * 8/2015 Anderson ..... F03G 7/081 701/37
2015/0251541 A1 * 9/2015 Drako ..... B60L 3/106 701/22

(Continued)

FOREIGN PATENT DOCUMENTS

CN 103255698 B 10/2015
CN 109291748 A 2/2019

(Continued)

*Primary Examiner* — Andrew R Dyer

(57) ABSTRACT

An electric propulsion system for a paver machine is disclosed. The system includes a battery and a plurality of electric motors connected to an inverter and powered by an electrical current injection from the battery. A plurality of wheels are propelled by the plurality of electric motors. A control unit employs a traction control operation which commands a second current injection into the plurality of electric motors, compares an actual speed to a maximum speed threshold of the plurality of electric motors, determine instances of slippage based on the actual speed and the maximum speed threshold, and modulates, upon instances of slippage, the first current to the plurality of electric motors from the inverter to change the actual speed and implement a traction control.

20 Claims, 4 Drawing Sheets

(56) References Cited

U.S. PATENT DOCUMENTS

| | | | | |
|---|---|---|---|---|
| 2016/0107539 | A1* | 4/2016 | Cox | B60L 50/51 701/3 |
| 2017/0110991 | A1* | 4/2017 | Frampton | B60L 1/003 |
| 2023/0235535 | A1* | 7/2023 | Eastman | E02F 9/2253 701/50 |
| 2023/0287635 | A1* | 9/2023 | Nagel | E01C 19/26 |
| 2024/0088703 | A1* | 3/2024 | Wang | H02J 7/04 |

FOREIGN PATENT DOCUMENTS

| | | | |
|---|---|---|---|
| CN | 209096407 | U | 7/2019 |
| DE | 102019004412 | A1 | 12/2020 |
| EP | 1245425 | A1 | 10/2002 |
| JP | 2013092002 | A | 5/2013 |
| WO | 2011057498 | A1 | 5/2011 |
| WO | 2016093382 | A1 | 6/2016 |

* cited by examiner

ELECTRIC PROPULSION SYSTEM FOR PAVER MACHINES

TECHNICAL FIELD

The present disclosure generally relates to paver machines, and more particularly relates to traction control systems for paver machines.

BACKGROUND

Wheeled asphalt pavers are essential machines in the construction industry, particularly in the paving of roads and other surfaces where precision and consistency are crucial. These paver machines are equipped with multiple wheels that propel them over various terrains, including compacted gravel, dirt, and newly laid asphalt. However, one of the persistent challenges in the operation of wheeled asphalt pavers is the occurrence of wheel slippage, particularly when the paver is operating on loose or uneven surfaces. Wheel slippage can result in defects in the asphalt mat being laid, leading to increased maintenance costs and delays in construction projects.

Traditional traction control systems in wheeled asphalt pavers often rely on mechanical sensors and additional components to detect and correct wheel slippage. These systems can be complex, expensive, and prone to maintenance issues. Moreover, the reliance on mechanical components can introduce delays in detecting and correcting slippage, potentially leading to further damage or inefficiencies in the paving process.

In recent years, there has been a shift towards the use of electric motors to drive the wheels of asphalt pavers and other paver machines. However, existing solutions often require the integration of additional sensors to monitor wheel speed and detect slippage, which can negate some of the benefits of switching to electric propulsion systems.

U.S. Pat. No. 9,982,401 discloses a road finishing machine with a control unit that detects the rotational speed of a rear wheel, calculates a target driving torque of a front wheel based on the measured rotational speed of the rear wheel and a measured travel speed of the road finishing machine. A slip condition of the rear wheel is determined based on the measured rotational speed of the rear wheel and the measured travel speed, wherein the travel speed of the road finishing machine is measured with a travel speed sensor unit. Then, an actual driving torque of the front wheel is adjusted to the calculated target driving torque. However, the prior art is a complex system that requires additional components for detecting wheel speed.

It can therefore be seen that a need exists for paver machine with improved performance and reliability, particularly during operations on loose or uneven surfaces.

SUMMARY

An electric propulsion system for a paver machine is disclosed. The system comprises a battery and a plurality of electric motors connected to an inverter and powered by a first electrical current injected from the battery. A plurality of wheels are propelled by the plurality of electric motors. A control unit employs a traction control operation configured to: commanding a second current injection into the plurality of electric motors; compare an actual speed to a maximum speed threshold of the plurality of electric motors based on responses from the second current; determine instances of slippage based on the actual speed and the maximum speed threshold; and modulate, upon instances of slippage, the first current to the plurality of electric motors from the inverter to change the actual speed and implement a traction control.

A paver machine is disclosed comprising a frame, a battery, a plurality of electric motors, a control unit. The plurality of electric motors are powered by a current provided from an inverter connected to the battery. A plurality of wheels are provided supporting the frame and propelled by the plurality of electric motors. A control unit employs a traction control operation configured to: commanding a second current injection into the plurality of electric motors; compare an actual speed to a maximum speed threshold of the plurality of electric motors based on responses from the second current; determine instances of slippage based on the actual speed and the maximum speed threshold; and modulate, upon instances of slippage, the first current to the plurality of electric motors from the inverter to change the actual speed and implement a traction control.

A method of employing traction control for a paver machine is disclosed. The paver machine is provided with a battery, a plurality of wheels, a plurality of electric motors powered by a first electrical current injected into the coils of the motors, an inverter, and a control unit. The method first injects a second electrical current into the plurality of electric motors. Next, the control unit compares an actual speed to a maximum speed threshold of the plurality of electric motors based on responses from the second current. Next, the control unit determines instances of slippage based on the actual speed and the maximum speed threshold. Finally, the control unit modulates, upon instances of slippage, the first current to the plurality of electric motors from the inverter to change the actual speed and implement traction control.

DETAILED DESCRIPTION

Figure 1:
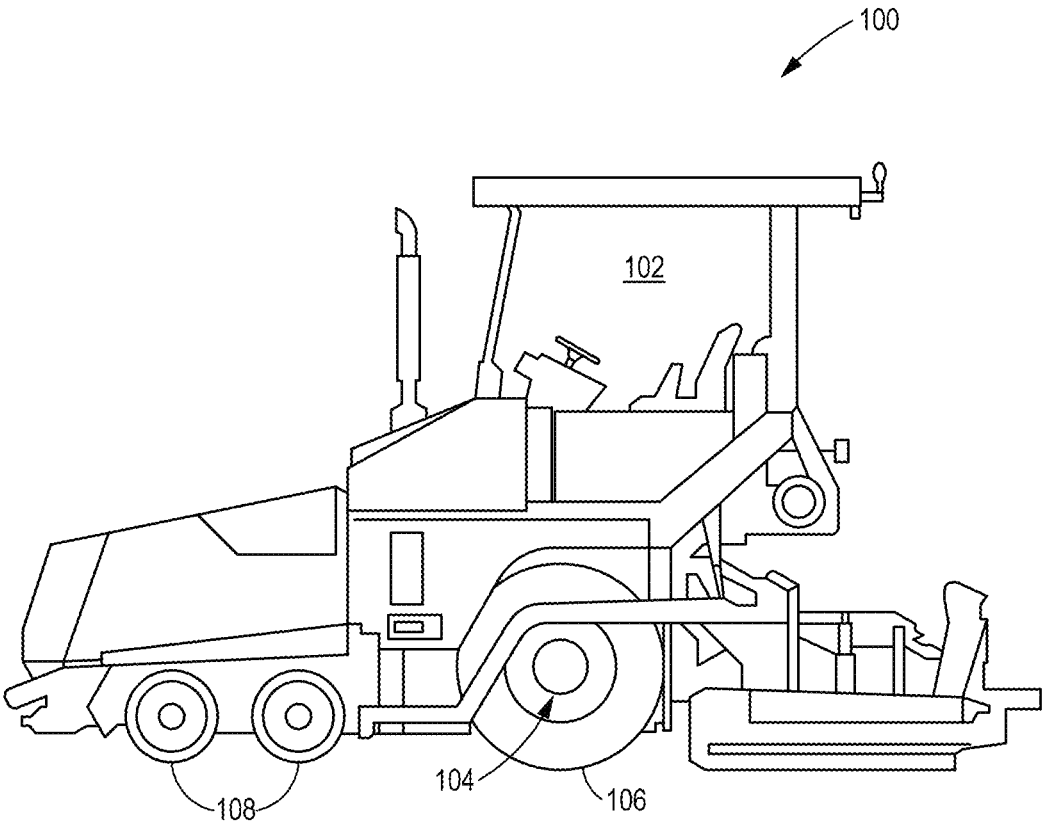
FIG. 1 is a side view of a paver machine.

Referring now to the drawings, and with specific reference to the depicted example, a paver machine 100 is shown, illustrated as an exemplary wheeled asphalt paver. Wheeled asphalt pavers are heavy equipment designed to lay asphalt and similar materials on road surfaces, ensuring smooth and consistent paving operations. While the following detailed description describes an exemplary aspect in connection with the wheeled asphalt paver, it should be appreciated that the description applies equally to the use of the present disclosure in other machines, including, but not limited to, wheel loaders, and similar equipment used in road paving construction and maintenance.

Referring to FIG. 1, a paver machine 100 is shown in a side view according to an embodiment of the present disclosure. The paver machine 100 is designed for laying asphalt and similar materials on road surfaces and other construction sites. The paver machine 100 includes a cab 102, which houses the operator controls and provides a sheltered area from which the operator can manage the machine's various functions.

The paver machine 100 is equipped with an electric propulsion system 104 that enables the machine to move across different terrains while maintaining stability and control. The electric propulsion system 104 ensures the paver machine 100 can lay asphalt, concrete, or other material evenly and consistently, even on uneven or loose surfaces.

A propulsion wheel 106 is provided at the rear of the paver machine 100. The propulsion 106 is typically driven by the machine's propulsion system and is responsible for a significant portion of the machine's traction and forward movement. At the front of the paver machine 100 are steering wheels 108. The steering wheels 108 assist in steering and stabilizing the paver machine 100 as it moves forward, ensuring that the paver machine 100 remains aligned and that the asphalt is laid in a straight and uniform manner.

Figure 2:
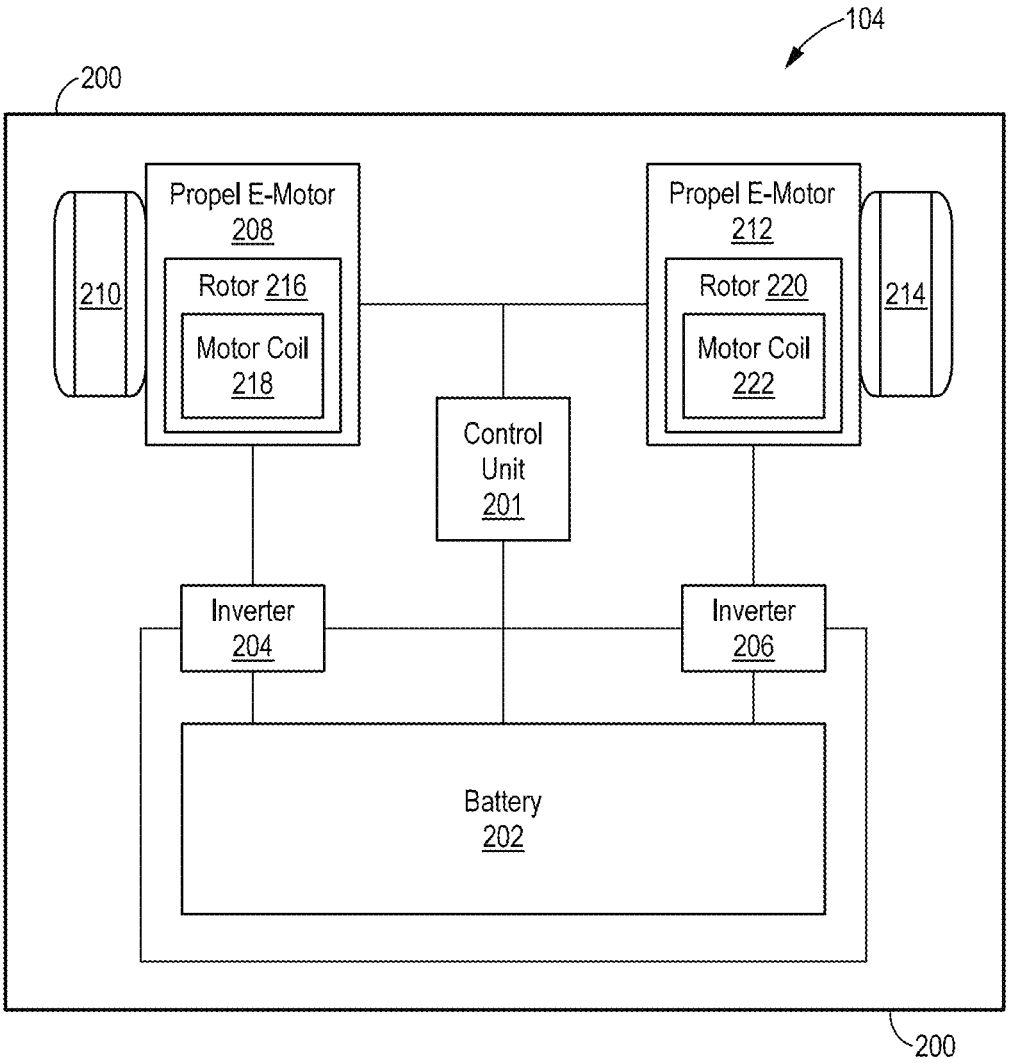
FIG. 2 is a block diagram illustrating an electric propulsion system of the paver machine of FIG. 1.

Referring to FIG. 2, a schematic diagram of the electric propulsion system 104 in the paver machine 100 of FIG. 1 is illustrated, according to an embodiment of the disclosure. The electric propulsion system 104 is controlled by a traction control system 200 having a control unit 201 and a battery 202 configured to power the electric propulsion system 104 of the paver machine 100. The traction control system 200, via the control unit 201, controls the motion of the paver machine 100 during pavement operations. The battery 202 stores electrical energy, allowing the paver machine 100 to operate for a period of time before needing to recharge.

The propulsion wheels 106 include a first wheel 210 and a second wheel 214, as shown and described in FIG. 2. The traction control system 200, in one embodiment, includes a first inverter 204 and a second inverter 206. The first inverter 204 is connected to a first propel electric motor 208 that propels a first wheel 210. The second inverter 206 is connected to a second propel electric motor 212 that propels a second wheel 214.

The first propel electric motor 208 is provided with a first rotor 216 having a first motor coil 218. The second propel electric motor 212 is provided with a second rotor 220 having a second motor coil 222. The control unit 201 manages traction control system 200, including operations of the propulsion wheels 106, the first inverter 204, the battery 202, the first inverter 204, the second inverter 206, the first propel electric motor 208, the second propel electric motor 212, the first rotor 216, the first motor coil 218, the second rotor 220, and the second motor coil 222. The first propel electric motor 208 drives the first wheel 210, providing the necessary force to move the machine forward and maintain traction.

The control unit 201 receives inputs from the operator and various components, processes this information, and sends commands to the battery 202, the first inverter 204, the second inverter 206, the first propel electric motor 208, the second propel electric motor 212, the first rotor 216, the first motor coil 218, the second rotor 220, and the second motor coil 222 to adjust the speed and torque of the first wheel 210 and the second wheel 214, as needed.

The control unit 201 in the paver machine 100 also controls various operational systems and components associated with the electric propulsion system 104 of the paver machine 100. The control unit 201 may manage the flow of power and electrical currents, monitor the operational status of each of the systems and components, and adjusting parameters to control performance of the electrical propulsion system 104, particularly in maintaining traction and limiting wheel slippage. Additionally, the control unit 201 may interface with external devices via wired or wireless connections to allow remote monitoring and control of the paver machine 100 and its associated systems and components.

The control unit 201 monitors the electrical current signals of the electrical current injected and being supplied to the first motor coil 218 and the second motor coil 222. By measuring the current signals, the control unit 201 can accurately measure the rotational speed of the first wheel 210 and the second wheel 214. The control unit 201 monitors the electrical current signals of the electrical current injected and being supplied to the first motor coil 8 and the second motor coil 222. By measuring the response to the injected current signals, the control unit 201 can accurately measure the rotational speed of the first wheel 210 and the second wheel 214.

The control unit 201 uses electrical current measurements to detect any discrepancies between the desired wheel speed and actual wheel speeds, as an indicator of wheel slippage. For instance, if the current signal indicates that the wheels 108 are rotating faster than expected for a given torque output, the control unit 201 may determine that slippage is occurring, especially on loose or compacted gravel, where traction can be inconsistent. Monitoring the electrical current injected in real-time helps the control unit 201 maintain precise torque control and detect wheel speed and slippage by monitoring the response to the electrical current injected.

The control unit 201 is further configured to employ traction control. The control unit 201 may further determine a position of the first rotor 216 and second rotor 220 of the first propel electric motor 208 and the second propel electric motor 212 based on changes of the current injection to the first motor coil 218 and the second motor coil 222. The control unit 201 calculates a wheel speed based on the determined rotor position over time and employs traction control when the wheel speed exceeds a rotational acceleration threshold.

The control unit 201 may be further configured to employ traction control by: comparing the wheel speed with a machine speed to detect slippage. The control unit 201 may determine the machine speed based on one or more wheel speed calculations, a speed setting of the paver machine, accelerometer tracking of the plurality of electric motors, and a GPS position sensor on paver machine, as generally known in the arts.

Figure 3:
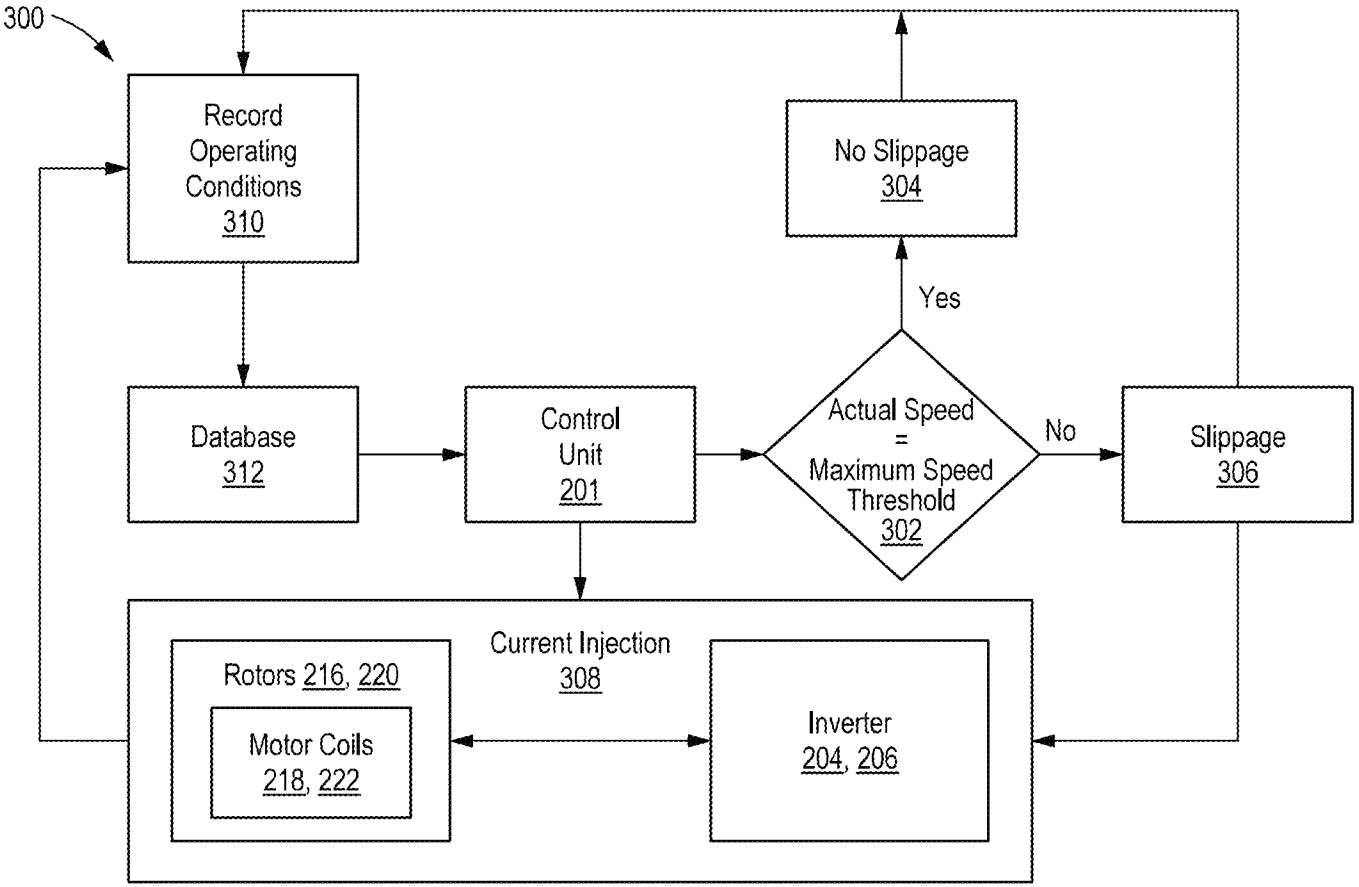
FIG. 3 is a flow diagram of a traction control system.

Now referring to FIG. 3, a flow diagram of a traction control operation 300 of the traction control system 200 is illustrated. In an operation 302, the control unit 201 determines if the actual speed of the first wheel 210 and the second wheel 214 is equal to a maximum speed threshold of the first wheel 210 and the second wheel 214. The actual speed is calculated from the output electrical current of the first propel electric motor 208 and the second propel electric motor 212 from the current injection sent to the motors from the first inverter 204 and the second inverter 206. The maximum speed threshold is a calculated value based on the commanded speed by the operator and the maximum acceleration allowed by the traction force of the tires on the ground surface before slippage occurs (i.e. based on the static friction force as opposed to dynamic friction force.

If actual speed is less than or equal to the maximum speed threshold, then the control unit 201 determines that no slippage is occurring, in an operation 304. The actual speed may also be considered equal to the maximum speed threshold when the actual speed is within a range of desired maximum speeds or within a set of desired speed thresholds. The control unit 201 receives feedback responses, referred herein as a "speed signal," from the electrical current injection of an additional amount of electrical current signal on top of, or in addition to, the first electrical current injected that is delivered to power the first motor coil 218 and the second motor coil 222 from the battery 202. The speed signal is indicative of the electrical current injected which allows the control unit 201 to determine the actual speed in real time by measuring the electrical current signals to measure the rotational speed of the first wheel 210 and the second wheel 214.

In an operation 306, if the actual speed of the first wheel 210 and the second wheel 214 is greater than the maximum speed threshold, then the control unit 201 determines that slippage is occurring. Upon detecting slippage, in an operation 308, the control unit 201 responds by adjusting the current supplied to the first inverter 204 and the second inverter 206 to the first motor coil 218 and/or the second motor coil 222.

The control unit 201 reduces the current supplied to the first motor coil 219 and/or the second motor coil 222 decreasing the motor torque, which in turn reduces the actual speed of the first wheel 210 and the second wheel 214. This adjustment or modulation helps to regain traction by ensuring that the first wheel 210 and the second wheel 214 are not spinning faster than the paver machine 100 can move beyond a rotational acceleration threshold and maximum speed threshold, thereby preventing the paver machine 100 from digging into the surface or getting stuck.

In an operation 310, the control unit 201 records the operating condition from the no slippage and slippage detections from operations 304, 306. In an operation 312, the operating conditions are recorded into a database which continuously updates the control unit 201 for predictive and improved traction control.

The control unit 201 continuously monitors the voltage and current at the inverter. By calculating the torque, voltage, current and power output, the control unit 201 can dynamically adjust these parameters in response to detected wheel slippage. The control unit 201 is further configured to determine instances of slippage and no-slip events while recording operating slip conditions of the paver machine 100 including voltage, current, and torque. The control unit 201 is further configured to update a traction control database with the continuously real-time operating slip conditions. The control unit 201 will utilize the traction control database to predict instances of slippage and employ traction control and modulate the electrical current to correct slippage.

The control unit 201 may be further configured to also send an alert signal to operator of the paver machine 100 upon detection of slippage. The control unit 201 may also initiate a braking operation associated with the paver machine 100 upon detection of a critical failure of the paver machine 100.

Figure 4:
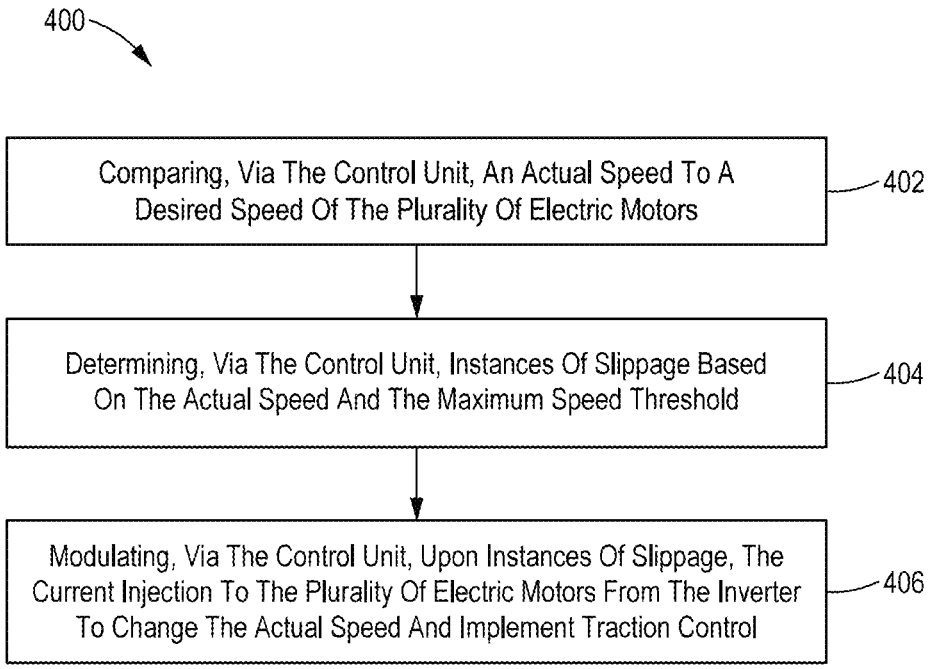
FIG. 4 is a flow-chart of employing traction control of a paver machine.

Referring to FIG. 4, a flow-chart illustrates a method 400 of employing traction control for the paver machine 100 is disclosed. The paver machine 100 is provided with the steering wheels 108, the propulsion wheel 106, the battery 202, the first inverter 204, the second inverter 206, the first propel electric motor 208, the second propel electric motor 212, the first rotor 216, the first motor coil 218, the second rotor 220, and the second motor coil 222 in communication with a control unit 201. The method 400 utilizes the control unit 201 to command a series of steps to employ traction control. The paver machine 100 is provided with the electric propulsion system 104 and the control unit 201 for controlling the traction of the plurality of wheels 108 and the propulsion wheel 106. The electric propulsion system 104 includes the battery 202 powering the first wheel 210 of the paver machine 100 with the first propel electric motor 208 and the second wheel 214 of the paver machine 100 with the second propel electric motor 212. The first propel electric motor 208 and the second propel electric motor 212 work in tandem to ensure balanced propulsion and optimal traction, particularly on loose or uneven surfaces where wheel slippage might occur.

In a step 402, the control unit 201 compares an actual speed to a maximum speed threshold of the first propel electric motor 208 and the second propel electric motor 212. The control unit 201 can measure the rotational speed of each wheel, using feedback from electrical current injected into the first motor coil 218 and the second motor coil 222, monitored by the control unit 201. The control unit 201 receives feedback responses of the measure electrical current signals, via the speed signal, from the electrical current injection of an additional amount of electrical current signal on top of, or in addition to, the first electrical current injected that is delivered to power the first motor coil 218 and the second motor coil 222 from the battery 202. By analyzing the feedback from the injected current signals, the control unit 201 can measure the speed of the first wheel 210 and the second wheel 214 without the need for additional speed sensors.

In a step 404, via the control unit 201 determines instances of slippage based on the actual speed and the maximum speed threshold. The control unit 201 determines whether wheel slippage is occurring by determining whether the actual speed is greater than the maximum speed threshold. Additionally, the control unit 201 may determine instances of slippage when a wheel speed exceeds a rotational acceleration threshold indicating that the wheel is slipping.

In a step 404, upon instances of slippage, the control unit 201 modulates the current to the first propel electric motor 208 and the second propel electric motor 212 from the first inverter 204 and/or the second inverter 206 to change the actual speed and implement traction control. In step 404, the control unit 201 may adjust the electrical current supplied to the first motor coil 218 and the second motor coil 222 of the first propel electric motor 208 and the second propel electric motor 212 to decrease the wheel speed and increase traction of the first wheel 210 and the second wheel 214, thereby reducing wheel slippage.

By reducing the electrical current, the control unit 201 lowers the torque output of the first propel electric motor 208 and the second propel electric motor 212, which in turn reduces the speed of the wheels 108, first wheel 210, and/or second wheel 214. This adjustment and modulation by the control unit 201 helps to regain traction by ensuring that the wheels 108, first wheel 210, and/or second wheel 214 are not spinning excessively on loose surfaces, such as compacted gravel, reducing the risk of the paver machine 100 becoming stuck or creating defects in the laid asphalt. The traction control system 200 dynamically adjusts the torque and speed of the first wheel 210 and the second wheel 214 based on the rate of how fast the electrical current rises within the first motor coil 218 and the second motor coil 222.

In the event of a detected or predicted slip condition, the control unit 201 modifies the torque distribution between the first propel electric motor 208 and the second propel electric motor 212 to correct the slippage. The control unit 201 may also reduce the torque to the slipping wheel and increase torque to the opposite wheel, if necessary, to prevent further slippage. The control unit 201 may be further configured to direct the traction control system 200 to reduce a torque or speed of the first propel electric motor 208 and/or the second propel electric motor 212 by controlling the electrical current at the first inverter 204 and the second inverter 206 upon instances of slippage.

Additionally, the control unit 201 may implement a slow-speed control when the paver machine 100 is operating at low or zero speed. During low-speed operations, the control unit 201 modulates the first current injected to maintain precise control over the rotor position and the resulting wheel speed. By maintaining control over rotor position and motor torque at low speeds, the control unit 201 ensures that the first wheel 210 and the second wheel 214 engage with the ground surface without causing unintended slip or misalignment especially when the paver machine 100 is transitioning from a stationary state to movement. During this transition, the control unit 201 may command an additional current injection into the first motor coil 218 and the second motor coil 222 to generate a smooth and controlled increase in motor torque, preventing sudden jerks or wheel spin that could otherwise lead to misalignment or uneven pavement laying.

Furthermore, the control unit 201 is provided with a predictive control module that employs machine learning algorithms to enhance traction control performance. The machine learning module is configured to continuously monitor and analyze the operational data of the paver machine 100, including current and voltage signals, torque output, and wheel speed. By comparing this data to known conditions of wheel slippage and machine performance stored in an internal database, the control unit 201 may identify patterns that indicate the onset of a slip condition, and updates the database with new operational data, allowing the traction control system 200 to refine its understanding of slip conditions and adapt to varying surface types, load conditions, and environmental factors. This predictive capability allows the control unit 201 to adjust the motor torque and speed preemptively, reducing the time required to respond to a slip event and minimizing energy losses due to wheel slip. This feedback loop ensures that even minimal slip is detected promptly, triggering the system to take predictive and corrective action immediately, such as adjusting the current injected from the first inverter 204 and the second inverter 206.

This method 400 optimizes the operation of the paver machine 100 by controlling wheel slippage without the need for additional physical sensors. The control unit 201 may further optimize and predict machine slippage conditions utilizing machine learning modules that continuously analyze operational data such as current, voltage, and torque values, as well as incorporating current machine conditions.

The control unit 201 may optimize and predict traction control by: (1) determining instances of slippage and no-slip events; (2) recording operating slip conditions of the paver machine including voltage, current, and torque of the instances of slippage and no-slip events; (3) updating a traction control database with the operating slip conditions; (4) predicting instances of slippage and employ traction control; and (5) further modulating the current injection to correct detected instances of slippage.

By referencing previously recorded slip events stored in the database in operations 310, 312, the control unit 201 can detect, optimize, and predict when the paver machine 100 is approaching a slip condition to preemptively reduce electrical current and/or motor torque at the first motor coil 218 and the second motor coil 222 to prevent or minimize the slip.

INDUSTRIAL APPLICABILITY

In operation, the present disclosure may find applicability in many industries, including, but not limited to, construction, road paving, earth-moving, and agricultural industries. Specifically, the systems, machines, and methods of the present disclosure may be used for controlling wheel slip and optimizing traction in machines such as wheeled asphalt pavers, wheel loaders, backhoes, skid steers, tractors, and other equipment that operates on loose or compacted surfaces. While the foregoing detailed description is made with specific reference to wheeled asphalt pavers, it is to be understood that its teachings may also be applied to other machines such as wheel loaders, skid steers, tractors, and the like having ground engaging elements such as wheels and tracks.

The traction control system 200 can be implemented across various machines and industries that require effective wheel speed control and slip detection. By utilizing electrical current injection into motor coils and analyzing the resulting electrical response, the control unit 201 can determine the actual wheel speed by monitoring how fast the current rises within the motor coils. The control unit 201 identifies wheel slippage based on the detected rate of change in current response allowing to accurately differentiate between conditions of full traction and potential slip events. The control unit 201 monitors the electrical current signals of the electrical current injected and being supplied to the first motor coil and the second motor coil. By measuring the response to the injected current signals, the control unit 201 can accurately measure the rotational speed of the first wheel and the second wheel.

The traction control system 200 has broad applicability across different paving environments, including urban settings with varying road surfaces and rural areas with uneven terrain. The traction control system 200's ability to adjust torque and speed dynamically based on real-time conditions enhances its utility in ensuring consistent paving quality, even under challenging conditions.

The traction control system 200 can be easily integrated into a wide range of modern asphalt pavers equipped with electric propulsion systems. By controlling the rate of electrical current injection and monitoring the response, the control unit 201 can maintain consistent wheel speeds and prevent unintended wheel spin or slippage for machines that require steady low-speed movement to perform operations such as paving or aligning attachments during construction activities.

By preventing wheel slip, the traction control system 200 not only improves the safety of the paving operation by reducing the risk of sudden machine movements but also enhances the efficiency of the paving process, especially at slow to zero speeds. The ability to maintain consistent wheel traction ensures that the paver moves steadily and uniformly, leading to a higher quality of the finished asphalt surface and reducing the need for costly rework or adjustments. The described system can be retrofitted onto existing machines with electric propulsion systems without significant mechanical modifications.

From the foregoing, the technology disclosed herein has industrial applicability in a variety of settings such as, but not limited to agricultural, construction, and mining industries that utilize machines such as asphalt pavers, concrete pavers, and other paver machines, including those with hybrid propulsion systems or varying wheelbase designs.

What is claimed is:

1. A method of employing traction control for a paver machine, the paver machine is provided with a battery, a plurality of wheels, a plurality of electric motors powered by a first current, an inverter, and a controller, the method comprising:

with the first current being provided to power the plurality of electric motors, injecting a second current into the plurality of electric motors via the inverter;

monitoring, at the inverter, responses from said injecting the second current into the plurality of electric motors;

comparing, via the controller, an actual speed based on the responses from said injecting the second current to a maximum speed threshold of the plurality of electric motors;

determining, via the controller, one or more instances of slippage based on the actual speed and the maximum speed threshold; and with the paver machine performing a paving operation, modulating, via the controller, upon instances of slippage, the first current to the plurality of electric motors from the inverter to change the actual speed and implement traction control.

2. The method of claim 1, wherein:

the actual speed is based on the responses received by said injecting the second current into the plurality of electric motors, and the maximum speed threshold is a calculated value based on a commanded speed of an operator and a maximum acceleration threshold based on a traction force of the plurality of wheels on a ground surface before slippage occurs, the method further comprising:

determining, via the controller, a position of a rotor in each of the plurality of electric motors based on based on the responses from the second current injected into a coil of the rotor via the inverter;

calculating, via the controller, a wheel speed based on the determined position of the rotor over time; and employing traction control, via the controller, when the wheel speed exceeds a rotational acceleration threshold or maximum speed threshold.

3. The method of claim 2, further comprising:

detecting instances of slippage and no-slip events;

recording operating slip conditions of the paver machine including the voltage, current, and the motor torque;

updating a traction control database with the operating slip conditions;

predicting instances of slippage and employ traction control; and further modulating the first current to correct detected instances of slippage.

4. The method of claim 3, further comprising:

employing a speed control setting during paving; and sending an alert signal upon detection of slippage.

5. The method according to claim 1, wherein said injecting the second current, said monitoring responses from said injecting, said comparing, and said determining are performed with the paver machine being stationary and transitioning from a stationary state to a moving state to perform the paving operation.

6. A paver machine comprising:

a frame;

a battery;

a plurality of electric motors powered by a first current provided from an inverter connected to the battery;

a plurality of wheels supporting the frame and propelled by the plurality of electric motors, the plurality of wheels being rear wheels of the paver machine; and a controller employing a traction control operation configured to:

with the first current being provided to power the plurality of electric motors, inject predetermined amounts of a second current into the plurality of electric motors via the inverter;

monitoring, at the inverter, responses from the injection of the predetermined amounts of the second current;

compare an actual speed based on the responses from the injection of the predetermined amounts of the second current to a maximum speed threshold of the plurality of electric motors;

determine instances of slippage based on the actual speed and the maximum speed threshold; and modulate, upon instances of slippage, the first current to the plurality of electric motors from the inverter to change the actual speed and implement a traction control for the paver machine.

7. The paver machine of claim 6, wherein:

the maximum speed threshold is a calculated value based on a commanded speed of an operator and a maximum acceleration threshold based on a traction force of the plurality of wheels on a ground surface before slippage occurs.

8. The paver machine of claim 7, wherein the controller is further configured to compare the wheel speed with a machine speed to detect slippage, and the machine speed is based on at least one chosen from the following:

one or more wheel speed calculations;

a speed setting of the paver machine;

accelerometer tracking of the plurality of electric motors; and a GPS position sensor on the paver machine.

9. The paver machine of claim 8, wherein:

the plurality of electric motors include a first electric motor and a second electric motor, the plurality of wheels include a first wheel and a second wheel, and the controller is further configured to:

modulate at least one of the first current to the first electric motor or the second electric motor to employ the traction control;

determine instances of slippage and no-slip events and record operating slip conditions of the paver machine including the voltage, current, and the motor torque;

update a traction control database with the operating slip conditions;

predict instances of slippage and employ the traction control; and further modulate the first current to correct detected instances of slippage.

10. The paver machine of claim 6, wherein the controller is further configured to:

determine position of a rotor of each of the plurality of electric motors based on changes of the first current injected to a coil of the rotor;

calculate a wheel speed based on the determined rotor position over time; and employ the traction control when the wheel speed exceeds a rotational acceleration threshold or the maximum speed threshold.

11. An electric propulsion system for a paver machine comprising:

a battery;

a plurality of electric motors powered by a first current provided from an inverter connected to the battery;

a plurality of wheels propelled by the plurality of electric motors; and a controller employing a traction control operation under a condition where the paver machine is stationary and transitioning from a stationary state to a moving state to perform paving, the controller being configured to:

with the first current being provided to power the plurality of electric motors to transition from the stationary state, inject predetermined amounts of a second current into the plurality of electric motors via the inverter, monitoring, at the inverter, responses from the injection of the predetermined amounts of the second current;

compare an actual speed based on the responses from the injection of the predetermined amounts of the second current to a maximum speed threshold of the plurality of electric motors;

determine instances of slippage based on the actual speed and the maximum speed threshold; and modulate, upon instances of slippage, the first current to the plurality of electric motors from the inverter to change the actual speed and implement a traction control for the paver machine during the transitioning from the stationary state to the moving state to perform the paving.

12. The electric propulsion system of claim 11, wherein:

the controller is further configured to employ the traction control by reducing torque or speed of the plurality of electric motors upon instances of slippage.

13. The electric propulsion system of claim 11, wherein:

the actual speed is based on the responses received by injecting the predetermined amounts of the second current into the plurality of electric motors to detect a rotor position of a rotor of each of the plurality of electric motors.

14. The electric propulsion system of claim 13, wherein:

the maximum speed threshold is a calculated value based on a commanded speed of an operator and a maximum acceleration threshold based on a traction force of the plurality of wheels on a ground surface before slippage occurs.

15. The electric propulsion system of claim 14, wherein the controller is further configured to employ a speed control for the paving.

16. The electric propulsion system of claim 14, wherein the controller is further configured to compare the wheel speed with a machine speed to detect instances of slippage, and the machine speed is based on at least one chosen from the following:

one or more wheel speed calculations;

a speed setting of the paver machine;

accelerometer tracking of the plurality of electric motors; and a GPS position sensor on the paver machine.

17. The electric propulsion system of claim 13, wherein the controller is further configured to:

determine the rotor position of the rotor of each of the plurality of electric motors based on changes of the predetermined amounts of the second current injected into a coil of the rotor;

calculate a wheel speed based on the determined rotor position over time; and employ the traction control when the wheel speed exceeds a rotational acceleration threshold or the maximum speed threshold.

18. The electric propulsion system of claim 11, wherein the controller is further configured to:

determine instances of slippage and no-slip events and record operating slip conditions of the paver machine including voltage, current, and torque;

update a traction control database with the operating slip conditions;

predict instances of slippage and employ the traction control; and modulate the first current to correct instances of slippage.

19. The electric propulsion system of claim 18, wherein the controller is further configured to:

send an alert signal upon detection of instances of slippage; and initiate a braking operation associated with the paver machine upon detection of a failure.

20. The electric propulsion system of claim 11, wherein:

the plurality of electric motors include a first electric motor and a second electric motor, the plurality of wheels include a first wheel and a second wheel, and the controller modulates the first current to the first electric motor and the second electric motor to employ speed measurements.

* * * * *